US007540105B2

(12) United States Patent
Case

(10) Patent No.: US 7,540,105 B2
(45) Date of Patent: Jun. 2, 2009

(54) READERBOARD SYSTEM

(75) Inventor: Patrick T. Case, Poncha Springs, CO (US)

(73) Assignee: National Readerboard Supply Company, Poncha Springs, CO (US)

( * ) Notice: Subject to any disclaimer, the term of this patent is extended or adjusted under 35 U.S.C. 154(b) by 0 days.

(21) Appl. No.: 10/697,681

(22) Filed: Oct. 29, 2003

(65) Prior Publication Data

US 2004/0128886 A1 Jul. 8, 2004

Related U.S. Application Data

(60) Provisional application No. 60/422,238, filed on Oct. 29, 2002.

(51) Int. Cl.
*G09F 7/02* (2006.01)

(52) U.S. Cl. ..... 40/618; 40/657

(58) Field of Classification Search ..... 40/618–622, 40/605, 657

See application file for complete search history.

(56) References Cited

U.S. PATENT DOCUMENTS 4,035,940 A * 7/1977 Mickey et al. ..... 40/605
4,505,061 A * 3/1985 Neuburger et al. ..... 40/489
5,606,834 A * 3/1997 Bauer ..... 52/506.01
5,832,643 A * 11/1998 Delaquila et al. ..... 40/611.01
6,178,678 B1 * 1/2001 Stoddard ..... 40/618
6,216,375 B1 4/2001 Griffin ..... 40/618
6,665,969 B1 * 12/2003 Conway ..... 40/605

OTHER PUBLICATIONS

Zip-Change® Numerals; 1 page information sheet, date unknown.

Zip-Change® Numerals specification sheet, Wagner Zip-Change, Inc, Melrose Park, Illinois, 1 sheet, (2000).

* cited by examiner

*Primary Examiner*—Cassandra Davis
(74) *Attorney, Agent, or Firm*—Sheridan Ross P.C.

(57) ABSTRACT

A graphic panel system for providing a message spanning all or substantially all of a readerboard is provided. According to embodiments of the present invention, panel elements may be combined to form larger graphic images and textual messages. The individual panel elements may be single track height, even though they contain graphics or images that, when the panels are attached to a readerboard, extend for more than one row of the readerboard. Graphic panels having first color images are also provided.

18 Claims, 6 Drawing Sheets

READERBOARD SYSTEM

CROSS-REFERENCE TO RELATED APPLICATIONS

This application claims the benefit of U.S. Provisional Application No. 60/422,238, filed Oct. 29, 2002, the entire disclosure of which is incorporated herein by reference.

FIELD OF THE INVENTION

The present invention relates to the provision of marquee graphic panels and to span-over marquee graphic panels. More particularly, the present invention relates to the provision of large, full color marquee graphic panels.

BACKGROUND OF THE INVENTION

Tracked readerboards or marquees provide tracks or slots in which two opposing edges of letter, number or word panels can be inserted. An example of a tracked readerboard 100 is shown in FIG. 1. As shown in FIG. 1, the readerboard 100 can accommodate word panels 104, letter or other character panels 108, and span-over panels 112. Readerboards are commonly used by retail stores, restaurants and other establishments to advertise offerings or to otherwise communicate information, because such readerboards 100 are relatively inexpensive, and can be readily changed to display different messages.

As shown in FIG. 2, taken along cross-section A-A of FIG. 1, word panels 104 and character panels 108 are typically provided in dimensions that allow such panels 104, 108 to occupy a single row 114 of the readerboard 100. The rows 114 are defined by tracks 116 having either one channel (e.g., tracks 116*a* and 116*c* at the top and bottom of the readerboard 100, respectively) or two channels (e.g., track 116*b*). With reference now to FIG. 3, a span-over panel 112 occupies at least a portion of two or more rows 114 of a readerboard 100. Accordingly, a span-over panel 112 allows a readerboard 100 having rows 114 of a first track height (or distance between tracks 116) to display panels having a height that is integral multiples of the provided row height, up to the total number of rows 114 provided by the readerboard 100. However, span-over panels 112 are prone to being blown out of a readerboard 100 by the wind.

A typical panel 104, 108 or 112 is formed on an acrylic substrate. Acrylic substrates have the advantage of being translucent, which is desirable when used in connection with readerboards 100 having internal lighting. Acrylic is also relatively inexpensive. However, acrylic is relatively brittle, and therefore panels 104-112 formed using acrylic substrates are easily broken, for example, when a panel 104-112 falls or is blown off of an elevated readerboard 100 onto pavement below.

The characters or words that have been used on panels 104-112 have been relatively simple and inexpensive to produce. For example, panels 104-112 may use characters formed from cut vinyl adhered to an acrylic substrate. Panels 104-112 may also have characters formed from ink deposited either directly on the acrylic panel or on an intermediate layer that is adhered to the acrylic substrate with relatively large blocks of a single, contiguous color. As a result, readerboard panels 104-112 usually are limited to the use of single colors, or of relatively large contiguous blocks of color, and relatively simple designs. Accordingly, readerboard panels have not featured full color graphic images. Furthermore, readerboard panel graphics have been limited in size, and have not extended across adjacent panels. Accordingly, readerboard panels have been limited in their visual impact. Large panels having graphics have been screwed to sign boards. However, the use of screws makes the panels difficult to attach and remove. In addition, such systems often damage the readerboard to which the graphic is attached. Accordingly, such systems have not been successful.

SUMMARY OF THE INVENTION

In accordance with an embodiment of the present invention, a marquee graphic panel or panel system is provided. The marquee graphic panel may include full color graphic elements. In addition, individual marquee graphic panels can be coordinated such that they can be combined to form a larger image. That is, individual panels may each comprise one portion of a larger image. In accordance with a further embodiment of the present invention, span-over panels may be combined with non-span-over panels, or span-over panels of different sizes. Furthermore, a number of non-span-over panels may be used in combination to present a larger image. For example, a number of individual panels may be used to create an image that covers all or a substantial portion of a readerboard to which the panels are attached. The panels are easily installed in or removed from a readerboard using the tracks of the readerboard.

According to an embodiment of the present invention, a full color marquee graphic panel is provided. According to such an embodiment, a full color graphic image is formed on a substantially non-breakable substrate, such as a polycarbonate resin. For example, a panel in accordance with the present invention may be formed on a LEXAN substrate. The full color graphic image may be formed either directly on the substrate, or on an intermediate layer that is adhered to the substrate. The full color graphic may be formed using an ink-jet process. In order to provide resistance to fading, the full color graphic may be formed from UV resistant inks, solvent based inks, and/or the image may be covered with a protective layer or film.

In accordance with another embodiment of the present invention, the graphic panel spans two or more rows of a readerboard or marquee. Accordingly, the panel may provide a relatively large surface on which to form the full color graphic image. In accordance with a further embodiment of the present invention, the full color graphic image is formed from four or more different colors of ink. According to still another embodiment of the present invention, the image is of photographic quality. Furthermore, the image may be formed using translucent inks, to provide a completed panel that is itself translucent.

In accordance with still another embodiment of the present invention, a method for advertising or promoting products or services is provided. According to the method, a full color graphic panel for use in connection with a readerboard is provided. The full color image depicts a product or service on offer. In addition, according to the method, a nongraphic reference to the image is presented, either proximate to the image, or removed from the image in time and/or space. For example, a full color graphic image positioned on a readerboard is displayed with a textual description of the product or service depicted in the image on the same readerboard. In accordance with another embodiment of the present invention, a non-graphical reference to the image is separated from the image in space. For example, a textual reference to the image may be made on a readerboard that is separate from the readerboard on which the full color graphic image is displayed.

In accordance with yet another embodiment of the present invention, the image may be displayed on a readerboard, for example, at a site offering the depicted product or service. The non-graphical reference to the full color image may be separated from the graphical image in space and time. For example, the non-graphical reference may be in the form of a radio or television commercial that is delivered to a consumer at a first time, while the consumer does not see the full color graphic panel until a second time.

These and other advantages and features of the invention will become more apparent from the following description of the invention taken together with the drawings.

DETAILED DESCRIPTION

Figure 1:
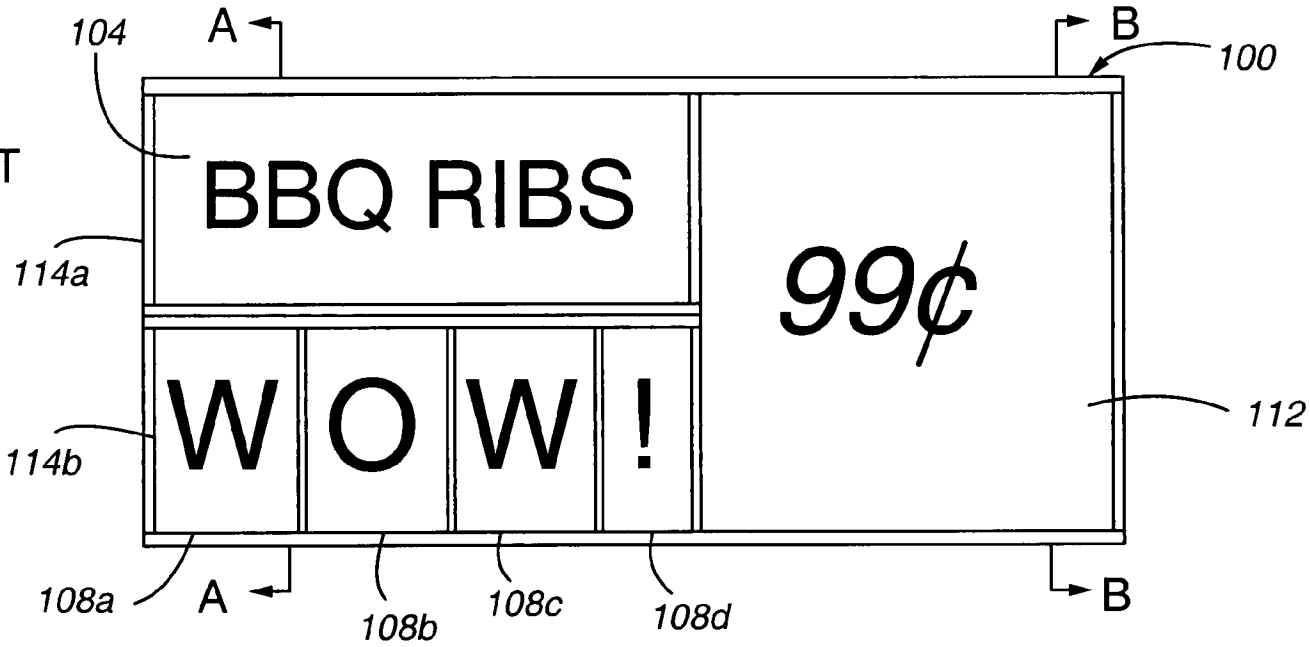
Fig. 1 PRIOR ART
FIG. 1 depicts a readerboard in accordance with the prior art.
Figure 2:
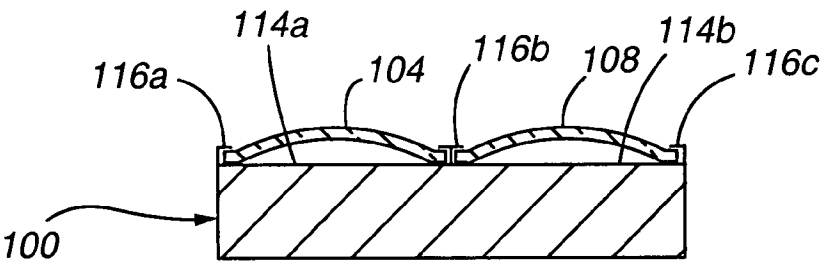
Fig. 2 PRIOR ART
FIG. 2 depicts the readerboard of FIG. 1 along cross-section A-A.
Figure 3:
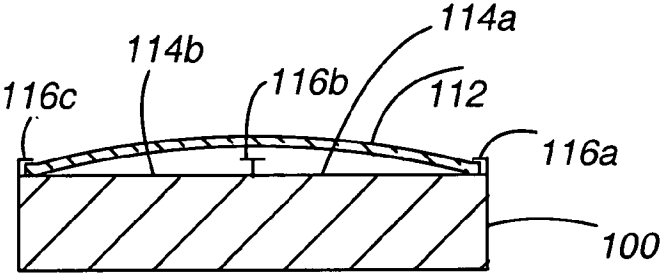
Fig. 3 PRIOR ART
FIG. 3 depicts the readerboard of FIG. 1 along cross-section B-B.
Figure 4:
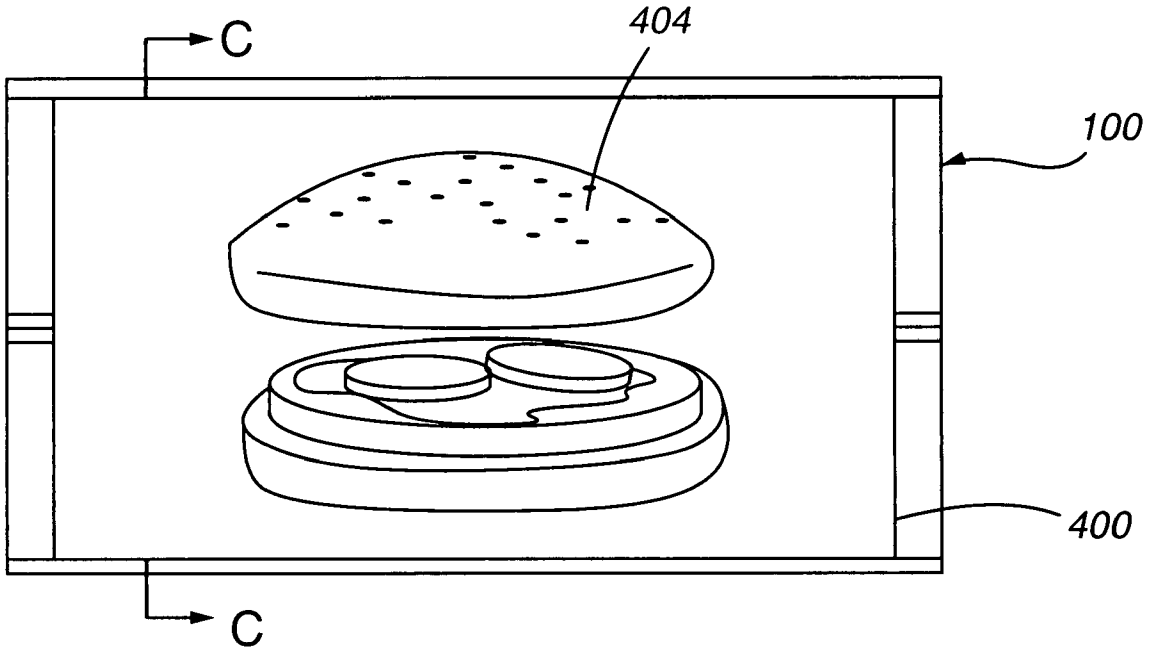
FIG. 4 depicts a full color graphic panel in accordance with an embodiment of the present invention.

With reference now to FIG. 4, a full size span-over graphic panel 400 in accordance with an embodiment of the present invention is illustrated. In general, the full-size span-over graphic panel 400 may be interconnected to a conventional readerboard or marquee 100. The full-size panel 400 includes a full color graphic image 404 depicting a product or service. The full color graphic image 404 is, according to an embodiment of the present invention, formed from four or more different colors of ink, allowing a full-spectrum of visible colors to be produced. Furthermore, the full color graphic image 404 may be of photographic quality. In accordance with an embodiment of the present invention, the image 404 is formed using cyan, magenta, yellow and black inks. Furthermore, an ink-jet process may be used to form the image 404.

Figure 5:
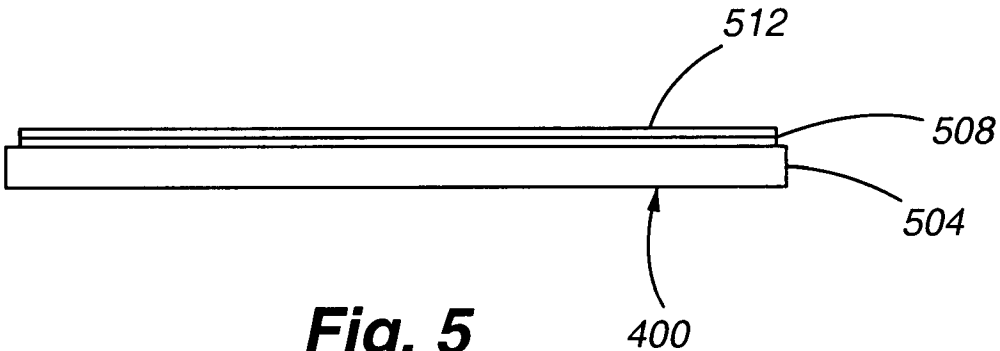
FIG. 5 depicts the full color graphic panel of FIG. 4 along cross-section C-C.

With reference now to FIG. 5, a full color span-over graphic panel 400 in accordance with an embodiment of the present invention is shown in an elevation taken along section line C-C of FIG. 4. As shown in FIG. 5, the full color span-over graphic panel 400 may include a substrate 504, an image layer 508, and a protective layer 512. In accordance with an embodiment of the present invention, the substrate 504 comprises a PETG or LEXAN panel. LEXAN provides a panel 400 that is translucent. In addition, a LEXAN is relatively resistant to breakage due to impacts, making it well-suited for use in connection with the presentation of images 404 that are relatively costly to produce, either because of their size or their quality. The image layer 508 generally provides a surface on which the image 404 is formed. For example, the image layer 508 may comprise a vinyl sheet, a paper sheet, or a MYLAR film on which the image 404 is formed by the deposition of ink using an ink jet printer. For instance, the image layer may comprise a self-adhesive vinyl sheet. As a further example, the image layer 508 may be interconnected to the substrate 504 using an adhesive. In accordance with an embodiment of the present invention, an adhesive used to interconnect the substrate 504 and image layer 508 provides good adhesion over a wide range of weather conditions. Such qualities are particularly important in connection with readerboards 100 placed in outdoor locations.

The protective layer 512 generally comprises a transparent film or layer adhered to the image layer 508. The protective layer 512 may function to protect the image layer 508 from weathering, including protecting the image 404 from fading due to exposure to sunlight. Accordingly, this protective layer 512 may comprise a sun screen.

In accordance with another embodiment of the present invention, the image 404 is formed from fade resistant inks or processes. For example, the image 404 may be formed using solid based inks. As a further example, the image 404 may be found using solvent based inks. The inks may be UV light resistant, to provide fade resistance when the graphic panel 400 is used outdoors. Therefore, a protective layer 512 need not be provided in connection with such an embodiment. Furthermore, a protective layer 512 may be omitted where the panel 400 will be displayed in an indoor or an otherwise protected location.

By providing for a full-size span-over panel 400 with a full color graphic image 404, relatively large images (i.e., images as large or about as large as a surface of a readerboard 100) can be displayed using a single panel 400. Furthermore, because the full-size panel 400 is compatible with conventional readerboards 100, the panel 400 can be easily and conveniently displayed or taken off of display, for example, to coincide with advertising campaigns related to the depicted product or service.

Figure 6:
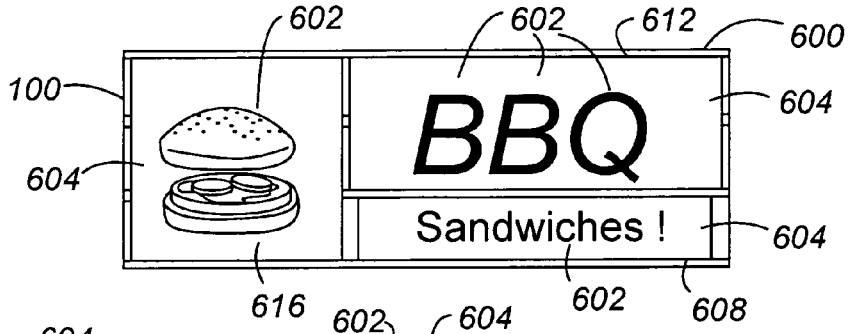
FIG. 6 depicts a graphic panel system in accordance with an embodiment of the present invention.

With reference now to FIG. 6, an embodiment of a readerboard or graphic panel system 600 in accordance with another embodiment of the present invention is illustrated. In general, the graphic panel system 600 includes a number of panel elements 604. As shown in FIG. 6, the panel elements 604 may include single track-height (i.e., non-span-over track height) panels 608, double track height (span-over) panels 612, and triple track height (span-over) panels 616. Panel elements 604 spanning more than three rows or track heights may also be provided. Because panel elements 604 in integer multiples of rows or track heights 114 are provided, the panel elements 604 may be interconnected to a conventional tracked readerboard 100. In addition, as also shown in FIG. 6, the panel elements 604 may have different lengths. For example, the panel elements 604 may have a length that is about equal to one-third of the length of a track.

The readerboard system 600 shown in FIG. 6 allows great flexibility in and combinations of graphic elements and descriptive (textual or numeric) elements, collectively referred to herein as semiotic elements 602. Furthermore, as used herein, the term semiotic elements may include stylized text, background colors or blank panels. Semiotic elements 602 that lend themselves to display using a panel element 604 having a single row or track height may be placed on single track height panel elements 608. Likewise, semiotic elements 602 that lend themselves to being displayed using panel elements 604 spanning two rows 114 may be formed on two track height elements 612. Furthermore, semiotic elements 602 lending themselves to display on panel elements 604 spanning three rows 114 may be displayed on panel elements spanning three tracks 616. As can be appreciated from the description provided herein, if panel elements 604 spanning more than three rows 114 are provided, then such panel elements 604 may be used in connection with semiotic elements 602 spanning more than three rows 114 on a single panel element 604.

As illustrated in the example readerboard system 600 of FIG. 6, by providing a number of panel elements 604 in different sizes, different panel elements 604 can be combined or arranged in different ways to provide different or updated messages, without requiring changing other of the panel elements 604. For example, a panel 604 containing a semiotic element 602 that uses text to describe a semiotic element 602 comprising a picture of an item on another panel element 604 can be changed without requiring removal of the panel element 604 containing the picture. As used herein, the term "message" includes or refers to text and/or graphics formed from semiotic elements 602 contained on one or more panel elements 604.

Figure 7:
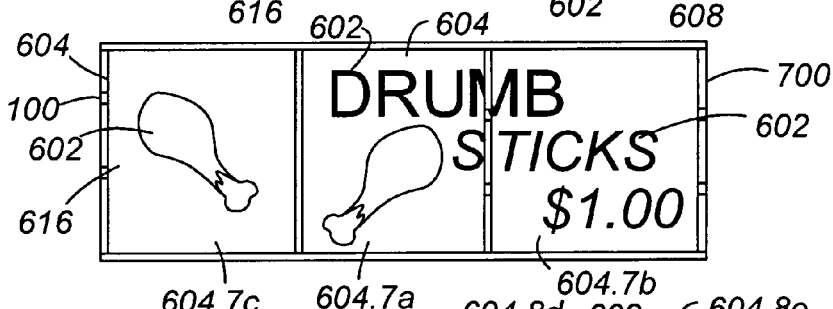
FIG. 7 depicts a graphic panel system in accordance with another embodiment of the present invention.

With reference now to FIG. 7, a readerboard system 700 in accordance with another embodiment of the present invention is illustrated. In the example of FIG. 7, panel elements 604 comprising three track height span-over panels 616 are shown interconnected to a conventional readerboard 100. Furthermore, the panel elements 604 in FIG. 7 contain semiotic elements 602 that produce, in combination, a continuous or substantially continuous graphic image and/or message. In particular, panel 604.7*a*, and panel 604.7*b*, when viewed together, spell the words "DRUMB" and "STICKS". If panel 604.7*a* were viewed separately from 604.7*b*, only a portion of each of the words would be viewable. Accordingly, panels 604.7*a* and 604.7*b* each contain a portion of an integrated message, rather than each containing an image or text that is complete when viewed in isolation. Furthermore, the panels 604.7*a* and 604.7*b* have semiotic elements 602 that are complementary to one another, in that the semiotic elements acquire meaning or completeness as a message or graphic when they are viewed together. Panel 604.7*c* may also contribute to the overall impression provided by the panel element 604 of the system 700. For example, in the illustrated example, panel 604.7*c* contains an image of a drumbstick. Therefore, panel 604.7*c* is complementary to panels 604.7*a* and 604.7*b*. In addition, panel 604.7*c* may form part of a continuous image, particularly if graphic elements extend across the borders between panels 604.7*a* and 604.7*c*, or if panel 604.7*c* has the same background color as panel 604.7*a*.

The readerboard system 700 illustrated in FIG. 7 allows large graphic images, text, or combinations of images and text to be displayed across all or substantially all of a readerboard 100 using a number of panel elements 604. Accordingly, the graphic image system 700 allows a relatively large, integrated textual message and/or a graphic display to be placed on the readerboard 100 using individual panel elements 604 that are smaller, and therefore more easily handled than a panel element that covers or extends across all or substantially all of a surface of the readerboard 100 (e.g., full size span-over graphic image panel 400). Ease of handling is of particular concern where the readerboard 100 is in an elevated or otherwise difficult to reach location.

Figure 8:
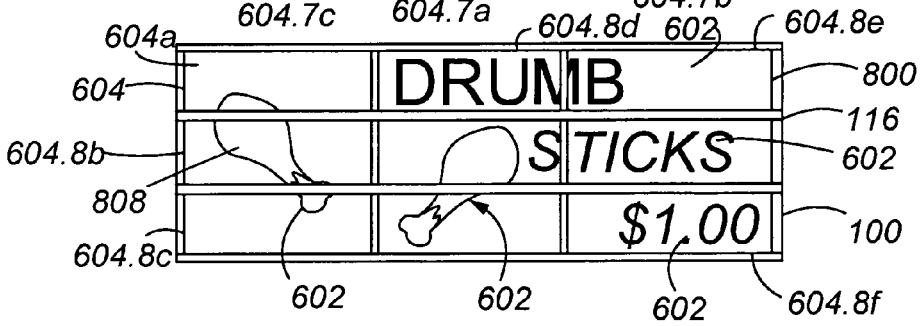
FIG. 8 depicts a graphic panel system in accordance with another embodiment of the present invention.

With reference now to FIG. 8, a readerboard system 800 in accordance with another embodiment of the present invention is illustrated. As shown in FIG. 8, the readerboard system 800 comprises a number of panel elements 604. In particular, the panel elements 604 of the readerboard system 800 have a single row or track height and a partial track length. As illustrated in FIG. 8, the individual panel elements 604 may contain semiotic elements 602 that, when viewed in combination, present a message that occupies all or substantially all of the area of a readerboard 100. Accordingly, substantially continuous graphic elements (e.g., drumbstick 808) may be presented across two or more of the panel elements 604. For instance, drumbstick 808 spans three separate panel elements 604.8*a-c*. Similarly, textual elements may span two or more panel elements 604. For example, the word "DRUMB" in FIG. 8 spans panel elements 604.8*d* and 604.8*e*. The graphic panel system 800 may also present one or more semiotic elements 602 that are contained within a single panel element 604. For example, in FIG. 8 the price "$1.00" is entirely contained within a single panel element 604.8*f*. Accordingly, by changing panel element 604.8*f* and only panel element 604.8*f*, the price of the item displayed and/or described on other of the panel elements 604 can be easily changed to reflect different market conditions. Furthermore, the panel element 604.8*f* can be visually integrated into the overall message presented by the other panel elements 604 by using the same background or a background that continues or echos semiotic elements 602 displayed by the other panel elements 604.

By providing a number of relatively small, like-sized panel elements 604, the graphic panel system 800 allows messages to be easily placed on the message board 100. In addition, because the panel elements 604 are single row height, they are more resistant to being blown out of the readerboard 100 by high winds than are span-over panels. Also, relatively small printers can be used, if desired, to produce the semiotic elements. Accordingly, a graphic panel system such as the system 800 shown in FIG. 8 allows messages to visually span all or substantially all of a readerboard 100, but can be made up of relatively small panel elements 604 containing semiotic elements 602 that comprise a portion of the overall message. Furthermore, even though opaque tracks 116 may cause breaks in the overall message, this is typically not noticeable to passers-by who glance at the readerboard 100 or who are traveling past the readerboard 100 in a vehicle. That is, the human brain will fill in the gaps between the panel elements 604, and the overall message will be communicated to that passer-by.

Figure 9:
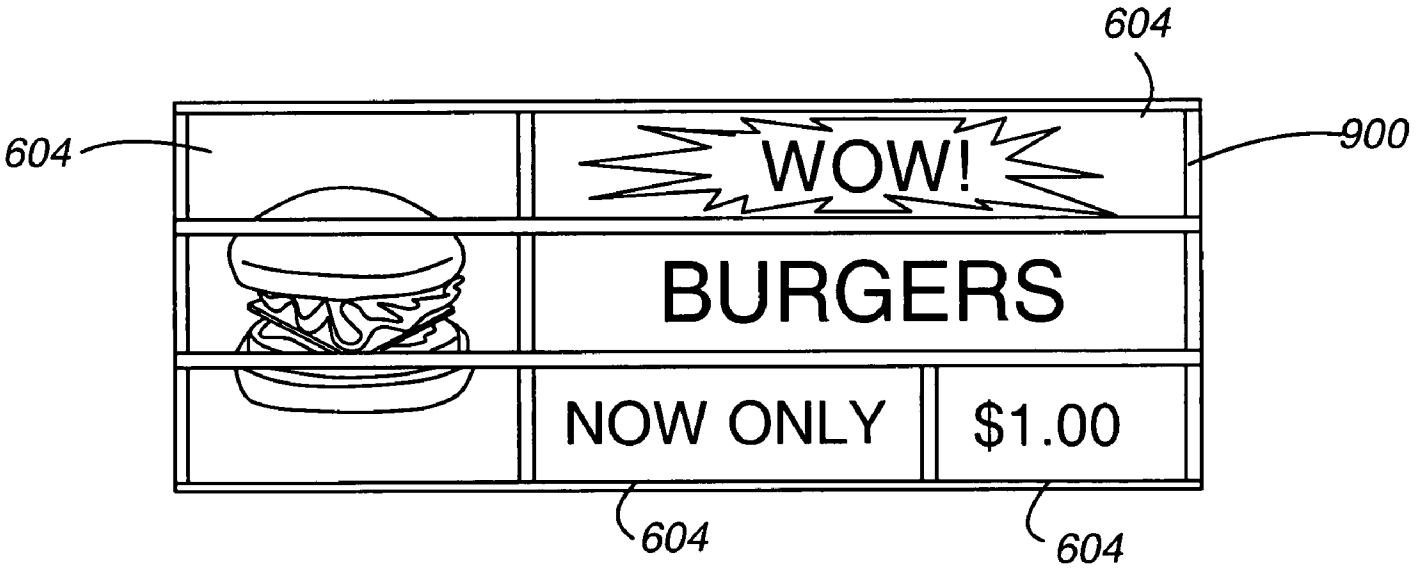
FIG. 9 depicts a graphic panel system in accordance with another embodiment of the present invention.

With reference now to FIG. 9, a graphic panel system 900 in accordance with another embodiment of the present invention is illustrated. As shown in FIG. 9, graphic panel system 900 may make use of a variety of different single row or track height panel elements 604. Accordingly, the elements of an overall message can be selectively changed. In addition, single track height panels 604 having lengths appropriate to the included semiotic element 602 can be provided. Furthermore, because the panel elements 604 are all single row or track height, the graphic panel system 900 provides good resistance to blow down, and easy assembly.

Figure 10:
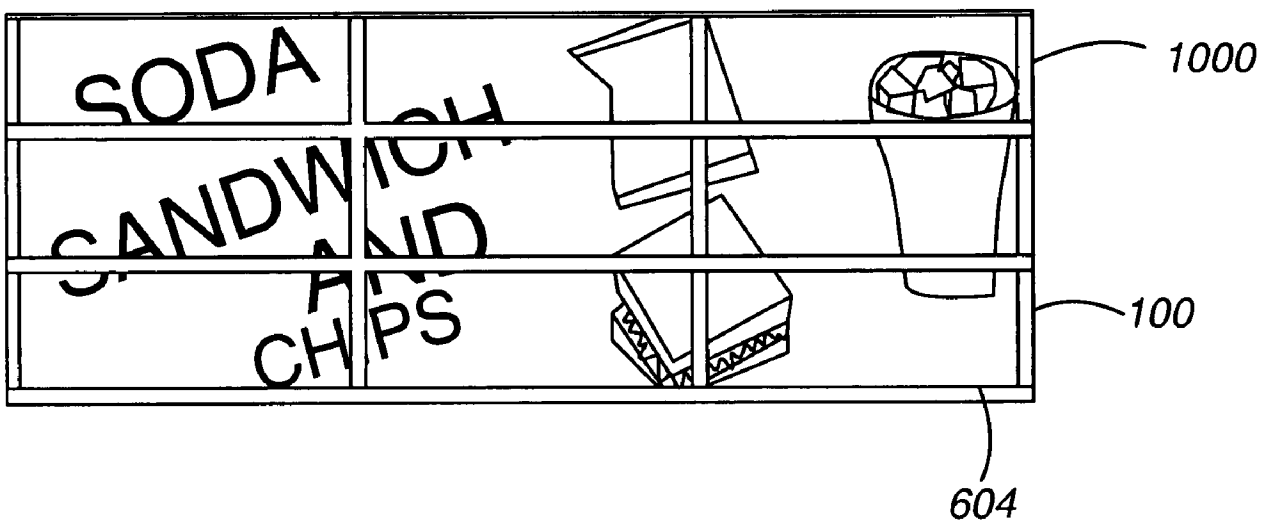
FIG. 10 depicts a graphic panel system in accordance with another embodiment of the present invention.

With reference now to FIG. 10, a graphic panel system 1000 in accordance with still another embodiment of the present invention is illustrated. In particular, a system 1000 comprising a number of regularly sized, single track height panel elements 604 is illustrated.

Furthermore, the individual panel elements 604 may contain graphics and/or text intended for viewing as an integrated whole. That is, each of the individual panels 604 is an integral part of an overall message. Accordingly, the graphic panel system 1000 illustrates how embodiments of the present invention can provide integrated messages spanning all or substantially all of a readerboard 100.

Figure 11:
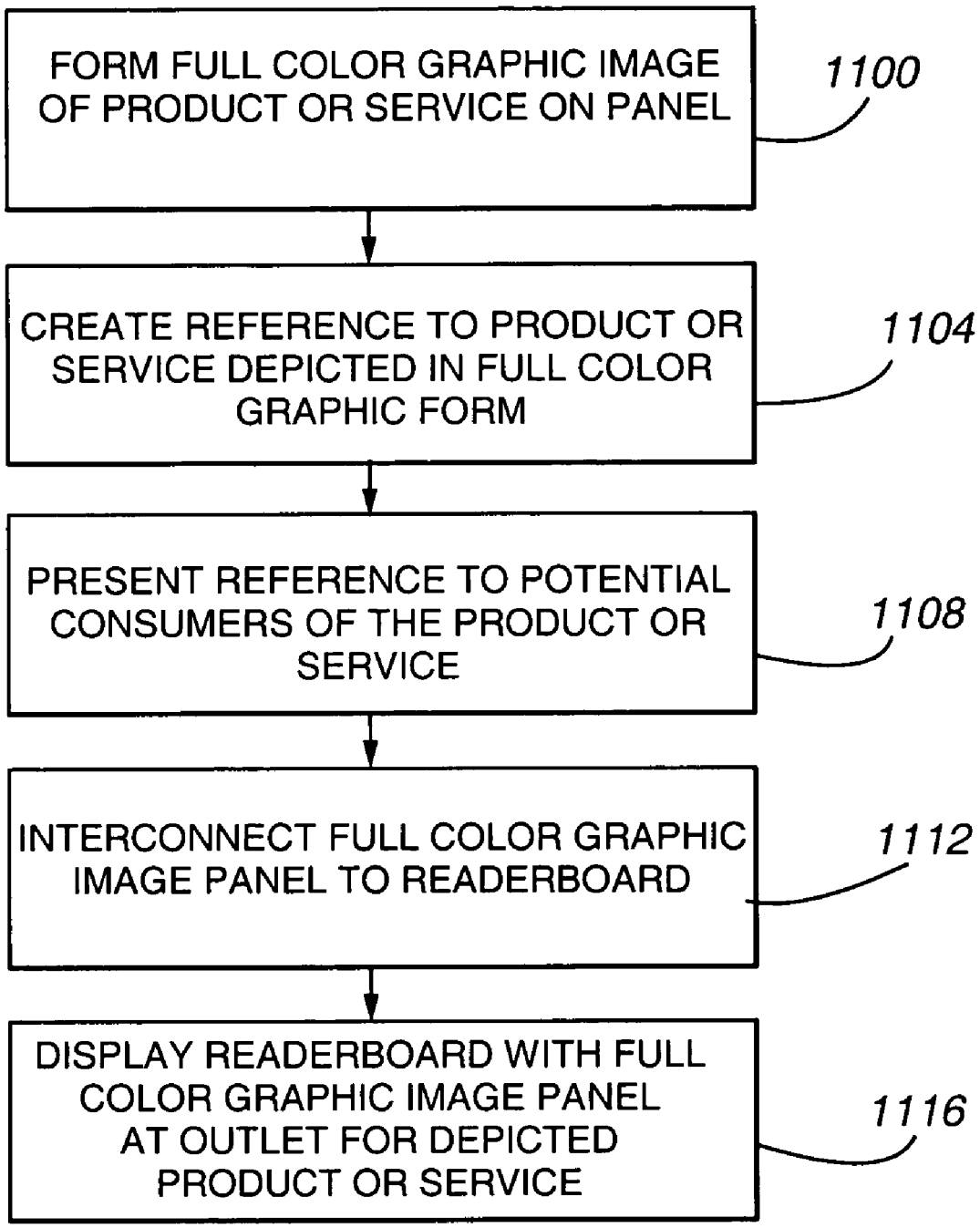
FIG. 11 is a flow chart depicting a method in accordance with an embodiment of the present invention.

With reference now to FIG. 11, a method in accordance with an embodiment of the present invention is depicted. In particular, at step 1100, a full color graphic image of the product or service being promoted is formed on a panel 400. For example, an inkjet printer is used to form a full color graphic image 404 on an image layer 508 that is laminated or adhered to a substrate 504 and covered by a protective layer 512. At step 1104, a reference to a depicted product or service is created. For example, a broadcast media advertisement referring to the product or service depicted in the full color graphic image 404 is created.

For instance, a restaurant franchise may create a television advertisement referring to and displaying an image of the sandwich that is also depicted in the panel 400.

At step 1108, the created reference is presented to potential consumers of the product or service depicted in the image 404 on the panel 400. For example, the television commercial concerning the featured sandwich is aired.

At step 1112, the full color graphic image panel 400 with the image 404 depicting the product or service being promoted is interconnected to a readerboard 100. The readerboard 100, with the full color graphic image panel 400, is then displayed at an outlet for the depicted product or service. For example, to continue the example of a restaurant promoting a sandwich, the panel 400 with the image 404 of the sandwich is displayed on a readerboard outside of a franchise outlet (step 1116).

Figure 12:
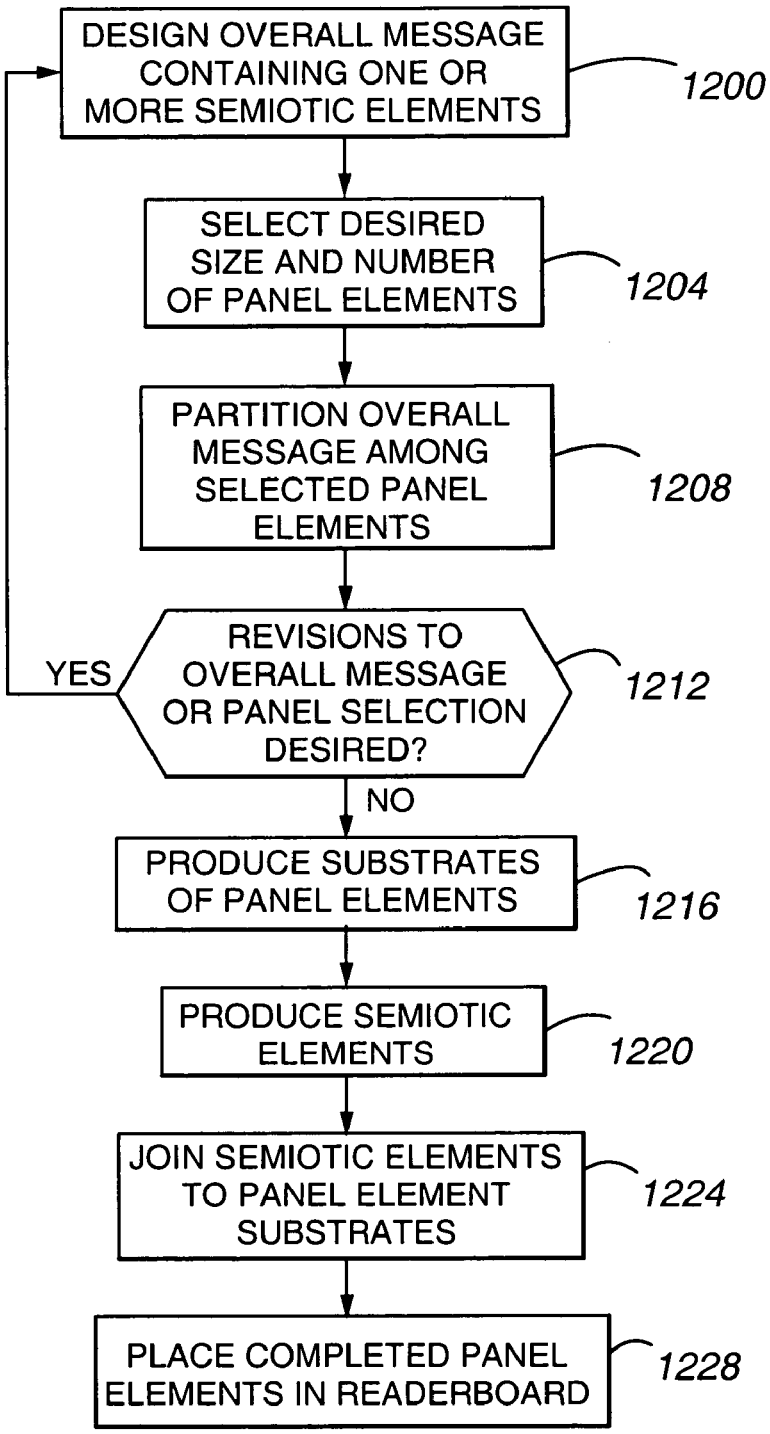
FIG. 12 is a flow chart depicting a method in accordance with another embodiment of the present invention.

With reference now to FIG. 12, a method in accordance with another embodiment of the present invention is depicted. In particular, at step 1200, an overall message containing one or more semiotic elements 602 is designed. Next, a desired number and size of panel elements 604 is selected. At step 1208, the overall message is partitioned among the selected panel elements 604. As can be appreciated by one of skill in the art, the steps of designing a message, selecting an arrangement of panel elements 604 and partitioning the overall message such that semiotic elements 602 are appropriately distributed on panel elements 604 can be performed substantially simultaneously. Furthermore, in different instances, different ordering of the steps may be appropriate. For example, a decision to use a number of single track height, less than full width panel elements 604 may be made initially, and the overall message would then be partitioned accordingly. Alternatively, the use of different sized panel elements 604 may be desirable where an overall message incorporating semiotic elements 602 comprising large graphical images and text that is likely to be changed independently of the graphical elements (e.g., a sales price) comprise the overall message.

At step 1212, a determination is made as to whether revisions to the overall message or panel selection is desired. For example, after laying out the overall message among the selected panel elements, it may become apparent that a modified arrangement would be preferable. After an arrangement has been decided upon, the substrates of the panel elements 604 are produced (step 1216). At step 1220, the semiotic elements 602 are produced. The semiotic elements 602 are then joined to the panel element substrates to produce completed panel elements 604 (step 1224). As can be appreciated by one of skill in the art, the particular processes involved in the completion of steps 1216, 1220 and 1224 will depend upon the selected materials and techniques for producing the panel elements 604. For example, in accordance with an embodiment of the present invention, the substrates of the panel elements are formed from LEXAN, and the semiotic elements 602 are formed by using an ink jet printer to place solvent based inks on a vinyl or MYLAR film. Continuing the present example, the MYLAR film on which the semiotic element or elements 602 has been printed is then adhered to the substrate. A sun screen film may then be applied over the MYLAR film on which the semiotic elements have been printed in order to provide resistance against fading due to exposure to the sun.

The completed panel elements 604 may then be placed in a readerboard 100 (step 1228). As can be appreciated from the description provided herein, in the present example, the overall message is represented using a number of semiotic elements placed on a number of panel elements 604. Accordingly, the order and the arrangement of the panel elements 604 in the readerboard 100 will generally be determined by the overall message. Usually, the correct ordering of the panel elements 604 in the readerboard 100 will be obvious to the installer. However, for example if a large number of panel elements 604 are used, the panel elements 604 may be numbered or otherwise coded to assist the installer in placing each panel element 604 in the correct position on the readerboard 100.

The inventor of the present invention has recognized that graphical images depicting a product or service can be a powerful draw to consumers. Furthermore, the inventor has recognized that readerboards provide an existing and convenient means for displaying such graphical images. However, there heretofore has been no viable way of displaying a relatively large graphical image in connection with a readerboard. In addition, it has been shown that the use of a readerboard displaying a full-color graphical image to promote a product or service can have a dramatic positive effect on sales of that product or service. For example, studies have shown that a readerboard displaying textual characters formed from letter panels 108 promoting a product or service can increase sales by 87%. Furthermore, it has been determined that the use of full color span-over graphic panels 400 with a graphic image 404 in accordance with the present invention depicting a featured product or service can increase sales by more than 240%. Accordingly, the present invention provides advantages that were previously unavailable using prior art panels 104-112. Furthermore, the magnitude of the increased sales associated with the use of embodiments of the present invention was much greater than expected. In particular, although some increase in sales was expected (e.g., 100%), the 240% or greater increase actually experienced was unexpected.

In addition, systems in accordance with embodiments of the present invention have met with considerable commercial success. For example, sales of panel elements having semiotic elements distributed thereon in accordance with embodiments of the present invention have been tested by major restaurant chains, and these tests have resulted in larger orders. For instance, McDonald's® ordered panel systems in accordance with an embodiment of the present invention for four restaurants and, based on the results of that initial test, ordered systems for an additional 80 stores. As a further example, a Sonic® restaurant ordered a system in accordance with an embodiment of the present invention. As a result of the success experienced by that restaurant, systems in accordance with embodiments of the present invention were ordered for an additional 8 stores. Sonic® then ordered systems in accordance with embodiments of the present invention for another 80 stores. As a further example of the commercial success of systems in accordance with embodiments of the present invention, Long John Silvers® is considering 3,600 systems for use in connection with its restaurants. As yet another example, a test of a system in accordance with an embodiment of the present invention at a Dairy Queen® restaurant has resulted in orders for an additional 50 systems.

In addition, embodiments of the present invention have been met with initial skepticism. For example, the customer who ordered the first system for the Sonic® restaurant in the above example expressed doubt that the system would improve sales. The actual increase in sales that were in fact experienced eventually lead to the order for systems for 80 Sonic® restaurants.

As can be appreciated from the description provided herein, embodiments of the present invention also provide images or messages that can be easily changed. For example, a graphic or image formed on multiple panel elements can be installed on a readerboard in under 3 minutes.

The foregoing discussion of the invention has been presented for purposes of illustration and description. Further, the description is not intended to limit the invention to the forms disclosed herein. Consequently, variations and modifications commensurate with the above teachings, within the skill and knowledge of the relevant art, are within the scope of the present invention. The embodiments described hereinabove are further intended to explain the best mode presently known of practicing the invention and to enable others skilled in the art to utilize the invention in such or in other embodiments and with various modifications required by their particular application or use of the invention. It is intended that the appended claims be construed to include the alternative embodiments to the extent permitted by the prior art.

What is claimed:

1. A readerboard system, comprising:

a first panel element, wherein said first panel element can be placed in a readerboard, and wherein a first semiotic element is formed on a first surface of said first panel element; and a second panel element, wherein said second panel element can be placed in said readerboard, wherein a second semiotic element is formed on a first surface of said second panel element, wherein said first and second semiotic elements are complementary such that they combine to form at least a portion of a substantially continuous message when said first and second panel elements are placed adjacent to one another, wherein said first semiotic element comprises at least one of a first portion of a graphic image and a first partial portion of a textual character, and said second semiotic element comprises at least one of a second portion of said graphic image that is a continuation of and complementary to said first portion of a graphic image and a second partial portion of said textual character that is a continuation of and complementary to said first partial portion of said textual character, wherein said first and second panel elements each have top and bottom edges capable of being engaged by track channels provided as part of said readerboard, wherein a bottom edge of said first panel element and a top edge of said second panel element are engaged by track channels of a first track of said readerboard, wherein said first semiotic element and said second semiotic element combine to form said at least a portion of the substantially continuous message without discontinuities when said first and second panel elements are registered with one another separate from the readerboard with the bottom edge of the first panel element and the top edge of the second panel element butted against one another, wherein said first track has a T-shaped cross-section;

wherein said first and second panel elements are separated from one another by the first track of said readerboard, wherein a first portion of said substantially continuous message at said bottom edge of said first panel element is obscured by the first track and is not displayed to a viewer when said first panel element is installed in a first row of said readerboard, wherein a second portion of said substantially continuous message at said top edge of said second panel element is obscured by the first track and is not displayed to a viewer when said second panel element is installed in a second row of said readerboard, and wherein said panel elements do not include any protrusions for engaging said track channels of said readerboard.

2. The system of claim 1, further comprising:

a third panel element, wherein said third panel element can be placed in said readerboard, said third panel element having a semiotic element formed thereon, wherein said third panel element is complementary to said first and second panel elements in that all three panel elements combine to form said substantially continuous message.

3. The system of claim 2, wherein said substantially continuous message extends across substantially all of a surface of a readerboard.

4. The system of claim 1, wherein each of said panel elements has a height of one track.

5. The system of claim 1, wherein at least one of said panel elements has a height of at least two tracks.

6. The system of claim 1, wherein a length of said panel elements is less than a length of a track.

7. The system of claim 1, wherein said first and second panel elements do not overlap one another.

8. The system of claim 1, wherein said first semiotic element comprises a first portion of a first textual character, wherein said second semiotic element comprises a second portion of said first textual character, wherein when said first and second panel elements are aligned with one another in said readerboard at least a portion of a complete representation of said first textual character has a location that corresponds to said track of said readerboard separating said first and second panel elements, wherein said complete representation of said first textual character is not visible to a viewer, whereby said viewer mentally completes said first textual character.

9. The system of claim 8, wherein at least some of said at least a portion of a complete representation of said first textual character that has a location that corresponds to said track of said readerboard is not represented on either of said first or second panel elements.

10. The system of claim 1, wherein said first semiotic element comprises a first portion of a first graphical element, wherein said second semiotic element comprises a second portion of said first graphical element, wherein said first graphical element does not comprise all or a portion of a textual message, wherein when said first and second panel elements are aligned with one another in said readerboard at least a portion of a complete representation of said first graphical element has a location that corresponds to said track of said readerboard separating said first and second panel elements, wherein said complete representation of said first graphical element is not visible to a viewer, whereby said viewer mentally completes said first textual character.

11. The system of claim 10, wherein at least some of said at least a first portion of a complete representation of said first graphical element that has a location that corresponds to said track of said readerboard is not represented on either of said first or second panel elements.

12. A readerboard system, comprising:

a readerboard, said readerboard including a plurality of tracks, wherein each track includes at least one channel;

a substrate, wherein said substrate is sized to span an integer number of readerboard rows; and a graphic image or text interconnected to said substrate, wherein said graphic image or text spans more than one of said readerboard rows, wherein said substrate and said interconnected graphic image or text comprise a plurality of panel elements, wherein each of said panel elements has a top edge held within a track channel and a bottom edge held within another track channel;

wherein a first portion of said graphic image or a letter included in said text is depicted on a first one of said panel elements, wherein a second portion of said graphic image or said letter is depicted on a second one of said panel elements, wherein first and second portions comprise the entire graphic image or letter and said graphic image or letter are without discontinuities in an area corresponding to an interface between said first and second panel elements, wherein said first and second portions of said graphic image or said letter are adjacent to one another and are separated from one another by a first one of said tracks of said readerboard, wherein a third portion of said graphic image or said letter comprising portions of said first and second portions of said graphic image or said letter corresponds to an area of said graphic image or said letter traversed by said first one of said tracks, and wherein said third portion of said graphic image or said letter is obscured by said first one of said tracks.

13. The system of claim 12, wherein each of said panel elements includes a semiotic element interconnected to a portion of said substrate.

14. The system of claim 13, wherein at least one of said panel elements spans a plurality of readerboard rows.

15. The system of claim 12, further comprising:

a protective layer overlaying said graphic image or text.

16. The system of claim 12, wherein said substrate is translucent.

17. The system of claim 12, wherein said graphic image or text is a full color graphic image formed from at least four different colors of ink.

18. The method system of claim 12, wherein at least a first of said plurality of panel elements has a semiotic element that is complementary to a semiotic element of a second of said plurality of panel elements, and wherein said first and second panel elements do not overlap one another.

* * * * *